US005640886A

United States Patent [19]

Lai

[11] Patent Number: 5,640,886

[45] Date of Patent: Jun. 24, 1997

[54] ASCENDING/DESCENDING STRUCTURE

[76] Inventor: Yu-Shan Lai, F4-3, No. 288, Tzu-Yu Rd., Chia-I Hsien, Taiwan

[21] Appl. No.: 597,273

[22] Filed: Jan. 6, 1996

[51] Int. Cl.[6] ..... G05G 5/06

[52] U.S. Cl. ..... 74/527; 74/594.7; 74/600

[58] Field of Search ..... 74/527, 528, 529, 74/594.7, 600, 562

[56] References Cited

U.S. PATENT DOCUMENTS

| | | | |
|---|---|---|---|
| 2,641,249 | 6/1953 | Brockman | 74/594.7 |
| 2,723,132 | 11/1955 | Oberwegner | 74/594.7 |
| 3,420,203 | 1/1969 | Ambrosh | 74/594.7 X |
| 4,225,130 | 9/1980 | Zimmerman | 74/594.7 X |
| 4,648,287 | 3/1987 | Preskitt | 74/600 X |
| 4,850,245 | 7/1989 | Feamster et al. | 74/600 X |
| 4,867,441 | 9/1989 | Blakeman | 74/562 X |
| 4,973,046 | 11/1990 | Maxwell | 74/594.7 X |
| 5,161,430 | 11/1992 | Febey | 74/594.7 |

*Primary Examiner*—Vinh T. Luong
*Attorney, Agent, or Firm*—Browdy and Neimark

[57] ABSTRACT

An ascending/descending structure including an engaging strip, a mating board, an engaging button, a U-shaped block, a receiving member and an ascending/descending bar. The ascending/descending bar is a rectangular hollow member formed with multiple pairs of opposite inner arch dents spaced by such a distance as to snugly receive the bottom end of the engaging button. The ascending/descending bar can be smoothly pulled upward and located for adjusting the height without slippage or loosening. When it is desired to push the ascending/descending bar downward, the same is first pulled upward to the top and a U-shaped block presses the engaging button and disengages the engaging button from the arch dents of the ascending/descending bar, permitting the same to be further pushed downward to the bottom,

1 Claim, 3 Drawing Sheets

1
2
3
4
5
6
31
34
35
41
42
51
61
62

ASCENDING/DESCENDING STRUCTURE

BACKGROUND OF THE INVENTION

The present invention relates to an ascending/descending structure.

Many kinds of appliances include ascending/descending structures for changing the height or length, such as an electric fan or a telescopic antenna. Several shortcomings exist in these structures as follows:

1. The locating members of the ascending/descending structures provide locating effect by means of conic profile or screwing measure which cannot achieve a reliable locking effect. When subject to external force, the locating members are apt to slide or loosen. Therefore, such locating members have poor stability and limited using range.
2. The screwing operation often needs to be repeatedly performed during use of the appliances. This causes great inconvenience to a user.

SUMMARY OF THE INVENTION

It is therefore a primary object of the present invention to provide an ascending/descending structure including an engaging strip, a mating board, an engaging button, a U-shaped block, a receiving member and an ascending/descending bar. The ascending/descending bar is a rectangular hollow member formed with multiple pairs of opposite inner arch dents spaced by such a distance as to snugly receive the bottom end of the engaging button. By means of the above arrangements, the ascending/descending structure has the following advantages:

1. The multiple pairs of opposite inner arch dents of the ascending/descending bar provide more reliable multi-stage locating effect, permitting the adjustment to be performed more smoothly.
2. The engaging button is more stably locked by the arch dents without slippage so as to bear heavier load.
3. The locating effect is achieved without using a screw so that the adjustment can be easily completed only by way of pulling and pushing.

The present invention can be best understood through the following description and accompanying drawings, wherein:

DETAILED DESCRIPTION OF THE PREFERRED EMBODIMENT

Figure 1:
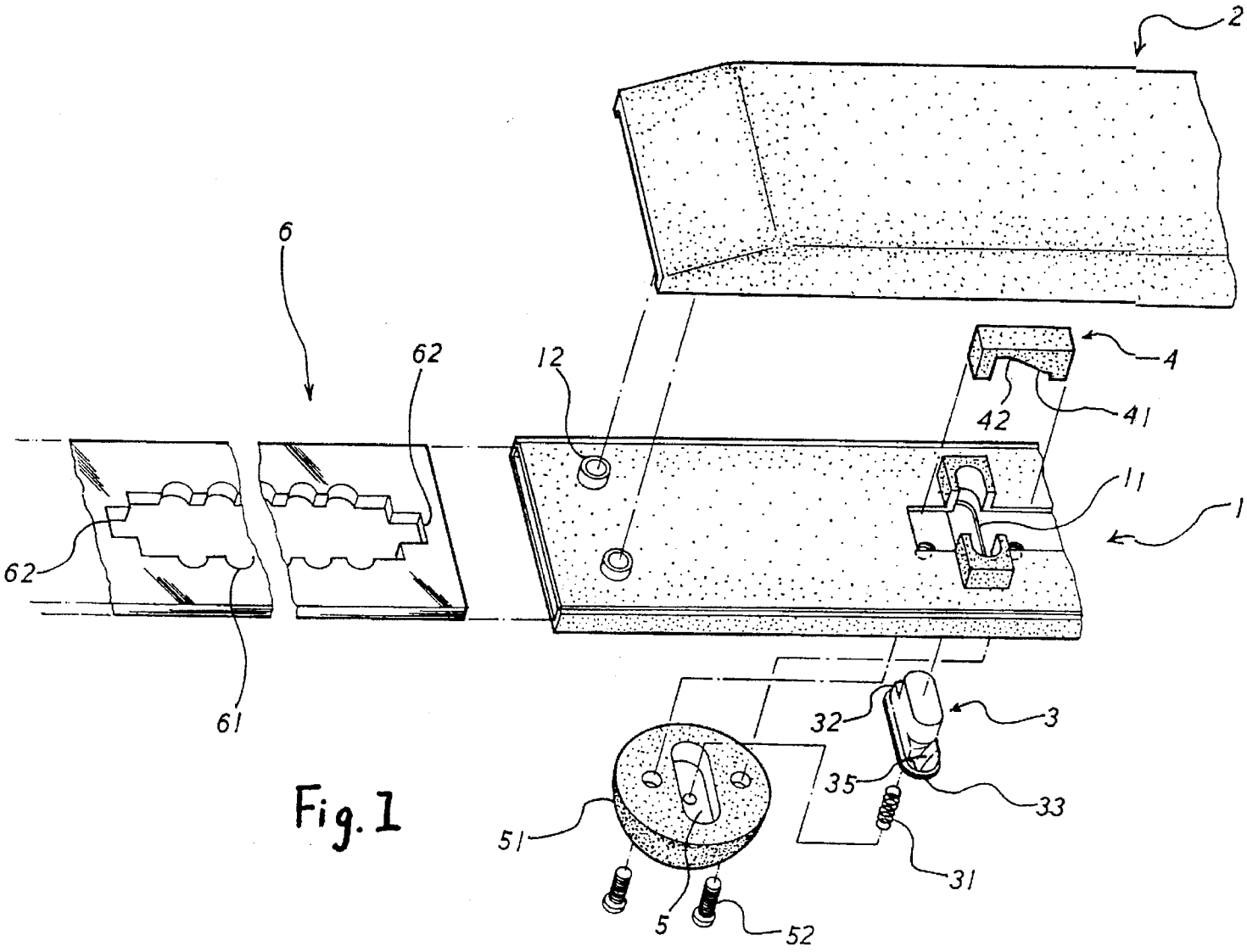
FIG. 1 is a perspective exploded view of the present invention.
Figure 2:
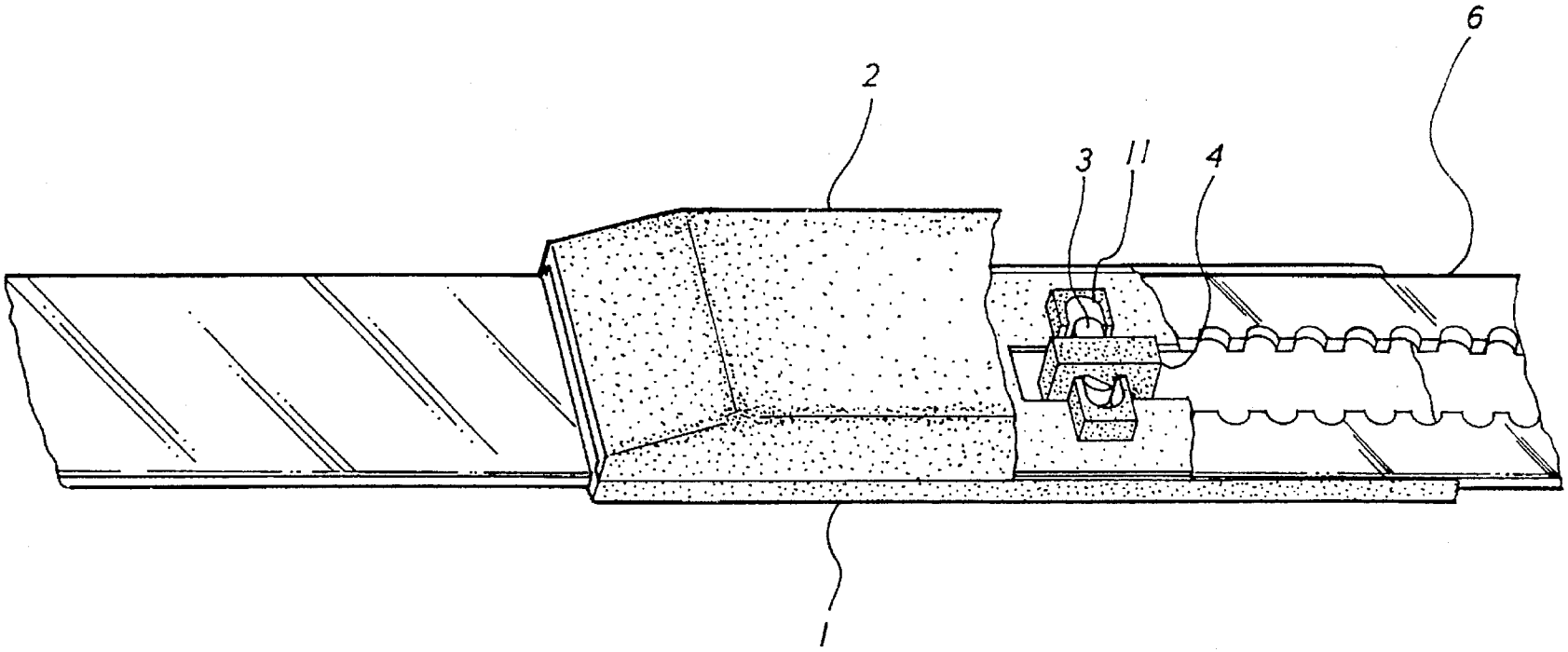
FIG. 2 is an assembled view of the present invention.
Figures 3, 3A, 3B, 3C:
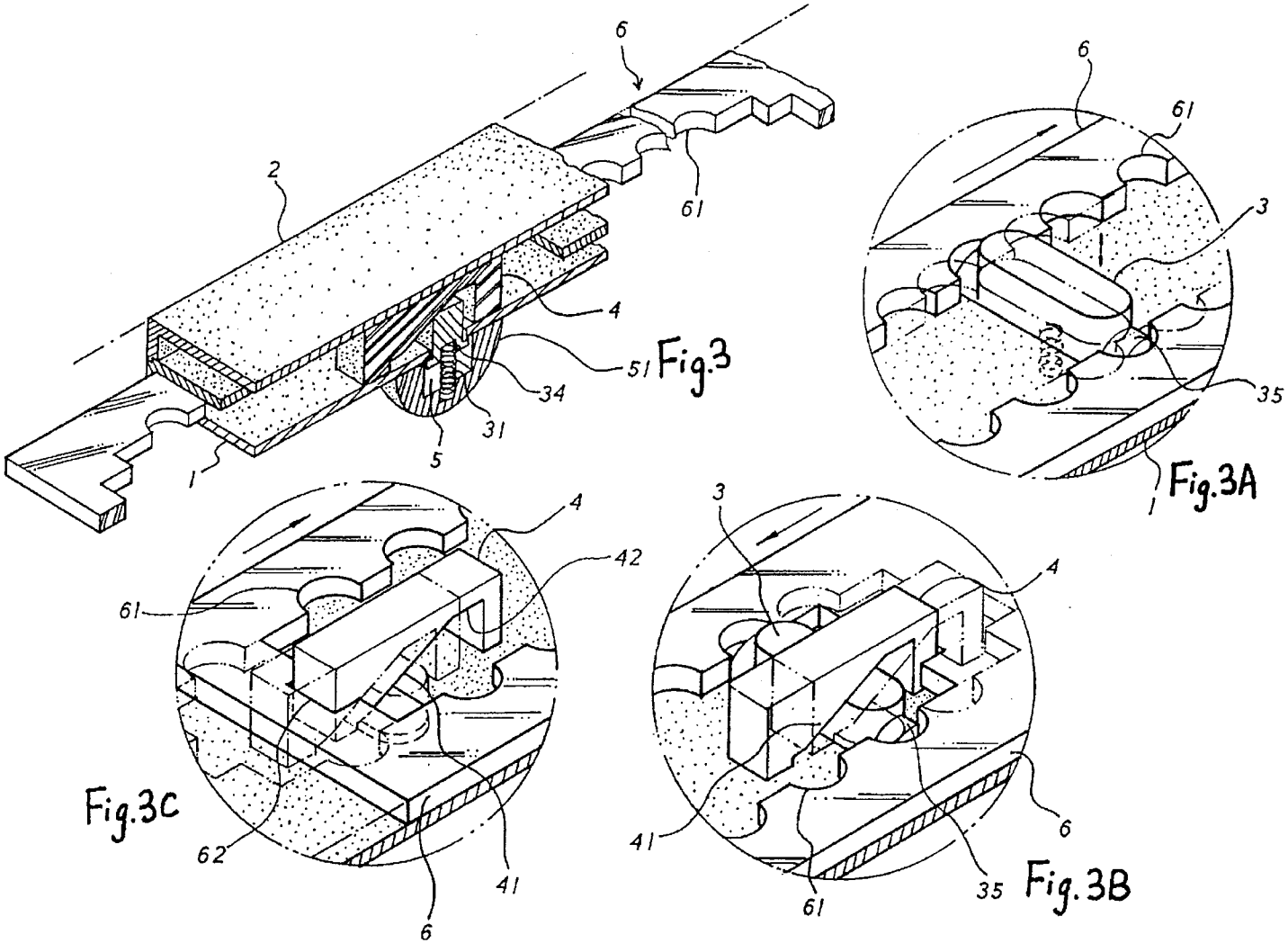
FIGS. 3 to 3*c* show the operation of the present invention.

Please refer to FIGS. 1 to 3. The present invention includes an engaging strip 1, a mating board 2, an engaging button 3, a U-shaped block 4, a receiving member 5 and an ascending/descending bar 6.

The engaging strip 1 is a rectangular hollow strip disposed with an elliptic slot 11 for receiving the engaging button 3 and multiple engaging bosses 12 for engaging with the mating board 2.

The mating board 2 is engaged with the engaging strip 1 for restricting the movement of the U-shaped block 4.

The engaging button 3 is an elongated elliptic block formed with a circular cavity 34 on bottom end 32 for receiving a spring 31. The bottom end 32 is placed in the receiving member 5. The bottom end 32 is formed with a flange 33 larger than the slot 11 and two slope faces 35 on two sides.

The U-shaped block 4 is formed with an inner slope portion 41 and a plane portion 42 for engaging with the top end of the engaging button 3.

The receiving member 5 is a semispherical body 51 formed with an elongated elliptic cavity and secured behind the slot 11 of the engaging strip 1 by screws 52 for receiving the engaging button 3.

The ascending/descending bar 6 is a rectangular hollow member formed with multiple pairs of opposite inner arch dents 61 spaced by such a distance as to snugly receive the bottom end 52 of the engaging button 3. Two inner recesses 62 are formed at upper and lower ends of the ascending/descending bar 6.

The ascending/descending bar 6 is inserted into the interior of the engaging strip 1 with one pair of the arch dents 61 aligned with the slot 11 of the engaging strip 1. The engaging button 4 is passed through the slot 11 from rear side to engage with the arch dents 61. A spring 31 is placed in the circular cavity 34 and the bottom end 32 of the engaging button 3 is received in the receiving member 5. Then the semispherical member 51 is secured behind the engaging strip 1 by screws 52. In addition, the plane portion 42 of the U-shaped block 4 is aligned with the top end of the engaging button 3 with the slope portion 41 parallel to the slope face 35 of the engaging button 3. Then the mating board 2 is engaged with the engaging strip 1 by the engaging bosses 12 so as to avoid detachment of the U-shaped block 4, When used, the ascending/descending bar 6 is pulled upward in the direction of the slope face 35 of the engaging button 3 for adjusting the height. (The slope face 35 serves to depress the engaging button 3 without engaging with the arch dents 61.) When subject to external force, because the other side of the engaging button 3 is free from any slope face, the slippage is avoided. After pulled upward for adjustment, when it is desired to push the ascending/descending bar 6 downward, the same is first pulled upward to the top. At this time, the recess 62 of the ascending/descending bar 6 will push the U-shaped block 4, forcing the slope portion 41 upward to press the engaging button 3 and disengage the same from the arch dents 61. Therefore, the ascending/descending bar 6 can be pushed downward to the bottom. At this time, the other recess 62 releases the engaging button 3 from the pressing force of the U-shaped block 4 and restores the engaging effect.

The above embodiment is only an example of the present invention and the scope of the present invention should not be limited to the example. Any modification or variation derived from the example should fall within the scope of the present invention,

What is claimed is:

1. An ascending/descending structure comprising an engaging strip, a mating board, an engaging button, a U-shaped block, a receiving member and an ascending/descending bar, said structure being characterized in that:

the engaging strip is a rectangular hollow strip disposed with an elliptic slot for receiving the engaging button and multiple engaging bosses for engaging with the mating board;

the mating board is engaged with the engaging strip for restricting the movement of the U-shaped block;

the engaging button is an elongated elliptic block formed with a circular cavity on bottom end for receiving a spring, the bottom end being placed in the receiving member, the bottom end being formed with a flange larger than the slot and two slope faces on two sides;

the U-shaped block is formed with an inner slope portion and a plane portion for engaging with the top end of the engaging button;

the receiving member is a semispherical body formed with an elongated elliptic cavity and secured behind the slot of the engaging strip by screws for receiving the engaging button; and the ascending/descending bar is a rectangular hollow member formed with multiple pairs of opposite inner arch dents spaced by such a distance as to snugly receive the bottom end of the engaging button, two inner recesses being formed at upper and lower ends of the ascending/descending bar, whereby the ascending/descending bar is inserted into the interior of the engaging strip with one pair of the arch dents aligned with the slot of the engaging strip, the engaging button being passed through the slot from rear side to engage with the arch dents, a spring being placed in the circular cavity of the engaging button, the bottom end of the engaging button being received in the receiving member, the semispherical member being secured behind the engaging strip by screws, the plane portion of the U-shaped block being aligned with the top end of the engaging button with the slope portion parallel to the slope face of the engaging button, the mating board being engaged with the engaging strip by the engaging bosses so as to avoid detachment of the U-shaped block.

* * * * *